United States Patent [19]

Kolton et al.

[11] Patent Number: 4,765,467

[45] Date of Patent: Aug. 23, 1988

[54] HANGER FOR NECKTIES AND SUSPENDERS

[75] Inventors: Chester Kolton, Westfield; Stuart S. Spater, Livingston, both of N.J.

[73] Assignee: B&G Plastics, Inc., New York, N.Y.

[21] Appl. No.: 49,795

[22] Filed: May 15, 1987

[51] Int. Cl.[4] ..... A47G 25/36; A47G 25/74

[52] U.S. Cl. ..... 206/296; 223/85; 223/87; 223/88; 223/DIG. 1; 206/278; 211/113; D6/315; 40/322

[58] Field of Search ..... 223/DIG. 1, 85, 87, 223/88; 211/13, 113; D6/315, 326; 206/278, 296; 40/322

[56] References Cited

U.S. PATENT DOCUMENTS

| | | | |
|---|---|---|---|
| D. 151,572 | 10/1948 | Tomarin | 223/DIG. 1 X |
| D. 167,986 | 10/1952 | Jonaitis | D6/315 |
| D. 182,259 | 3/1958 | Tupper | 223/DIG. 1 X |
| 2,605,000 | 7/1952 | Tomarin | 223/DIG. 1 X |
| 3,136,419 | 6/1964 | Ruderian | 223/87 X |
| 3,243,087 | 3/1966 | Pulitzer | 223/DIG. 1 X |
| 3,378,180 | 4/1968 | Singer | 223/87 |
| 3,398,867 | 8/1968 | Taylor et al. | 223/87 |
| 3,710,996 | 1/1973 | Smilow et al. | 223/87 |
| 3,900,181 | 8/1975 | Pitanis | 223/87 X |

*Primary Examiner*—Robert R. Mackey

*Attorney, Agent, or Firm*—Robin, Blecker & Daley

[57] ABSTRACT

A hanger for the hanging of both a necktie and suspenders comprises an integral body having a first portion for engaging a display rod, and a second portion depending from said first portion and defining at least one pair of suspender hanging openings and further defining a necktie hanging opening in the body and bounded throughout by continuous wall structure of the body, the hanger body supporting first and second deflectable members extending collectively across a major extent of the necktie hanging opening and defining thereby first and second portions thereof for respective receipt and retention of successive courses of the necktie.

10 Claims, 3 Drawing Sheets

HANGER FOR NECKTIES AND SUSPENDERS

FIELD OF THE INVENTION

This invention relates generally to hangers for the hanging of neckties and suspenders and pertains more particularly to hangers for the joint hanging of neckties with suspenders of the type having snaps adapted to receive and retentively close upon a trouser waistband.

BACKGROUND OF THE INVENTION

Copending applications of applicants herein, Ser. Nos. 882,486 and 882,487, both filed on July 7, 1986, now U.S. Pat. No. 4,714,156, granted Dec. 22, 1987 and U.S. Pat. No. 4,718,546, granted Jan. 12, 1988, respectively, and commonly assigned herewith, address the hanging of suspenders of the type having stems with slots therein for receiving buttons disposed interiorly on a trouser waistband. Both such hangers are in the form of a flat body having a hook portion upwardly of suspender stem engaging structure. In the former patent application, the hanger has a pair of openings extending therethrough and an elongate member is cantilever-supported in each such opening and configured compatibly with a suspender stem and its button slots to retain the stem by releasable engagement with both slots thereof. In the latter patent application, the hanger has a pair of foldable straps dependent therefrom, each strap being configured compatibly with a suspender stem to receive and retain both slotted ends thereof.

Another type of suspenders is known in the art, namely of the type having stems equipped with snaps adapted to receive and retentively close upon the waistband of trousers, without need for the trouser waistband to have suspender buttons. This type of suspenders is quite popular, since many trousers do not come equipped with such suspender buttons.

The snap type suspender presents a display problem not faced in connection with the previously described suspender. Thus, such snaps are desirably closed at the point of manufacture to facilitate shipment thereof without suspenders bccoming entangled with one another. This is in contrast to the stem/slot type of suspenders, which are shipped with stem slots free but not likely to give rise to suspenders entanglement. Since heretofore known hangers are not adapted at all to the retention of the snaps of snap type suspenders in closed state, they do not afford a solution to the problem presented at the point of manufacture as it impacts on display at the point of sale. Opening and closing suspender snaps to effect display is of course not a meaningful solution since it consumes labor and is inefficient.

In a further commonly assigned application, Ser. No. 49,794 entitled "Hanger for Suspenders with Trouser Snaps", filed concurrently herewith, a suspender hanger is provided which overcomes the foregoing problem. Such hanger, in summary, provides a hanger for the hanging of suspenders of the type having snaps which, in first state, are open to receive the waistband of trousers, and, in second state, are closed retentively upon such waistband. The hangers of the invention comprise an integral body of resilient synthetic material having a first or upper, hook portion for engaging a display rod, and a second or lower portion, depending from the first portion and defining at least one pair of openings therethrough, each bounded in first part by continuous wall structure of the integral body and in second part by a discontinuity in the hanger body providing a passage into such opening. First and second segments of the wall structure respectively aside the passage are mutually deflectable, permitting the receipt in such opening of a suspender snap in such closed state thereof, and are then reversely deflectable to retain the snap.

Typically, each snap has first and second closable jaws on the interior of each of which is secured a resilient pad which frictionally engages the trouser waistband. Each hanger opening is sized to receive and circumscribe the resilient pads of a snap.

Current fashion trends have developed a substantial market for coordinated suspenders and neckties. Accordingly, need exists for expeditious joint display thereof.

SUMMARY OF THE INVENTION

The present invention has as a primary object thereof the provision of improved hangers for neckties and suspenders.

A particular object of the invention is to provide hangers for the hanging of neckties jointly with suspenders of the type having snaps adapted to receive and retentively close upon a trouser waistband.

In the attainment of the foregoing and other objects, the invention provides a hanger for the hanging of both a necktie and suspenders of the type having snap means in first open state for receiving a trouser waistband and in second closed state for closure retentively upon said waistband. The hanger comprises an integral body having a first portion for engaging a display rod, and a second portion depending from said first portion and defining at least one pair of suspender hanging openings therethrough, each suspender hanging opening being bounded in first part by continuous wall structure of the body and in second part by a discontinuity in the body providing a passage into the suspender hanging opening. First and second segments of the said wall structure respectively aside said passage are mutually deflectable, permitting the receipt in the suspender hanging opening of the suspender snap means in such closed state thereof. The hanger further defines a necktie hanging opening in the body and bounded throughout by further continuous wall structure of the body, the hanger body supporting first and second deflectable members extending collectively across the major extent of the opening and defining thereby first and second portions of such opening enterable upon deflection of the first and second members. A necktie is looped and the loop is applied to either such member in deflected state thereof, thereby capturing the loop and hanging the necktie.

The hanger may include a third portion depending from the second portion thereof, with the necktie hanging opening being disposed in the third hanger portion. Alternatively, the necktie hanging opening may be disposed in alignment with the suspender hanging openings.

The foregoing and other objects and features of the invention will be further understood from the following detailed description of preferred embodiments thereof and from the drawings wherein like reference numerals identify like parts throughout.

DESCRIPTION OF PREFERRED EMBODIMENTS AND PRACTICES

Figure 1:
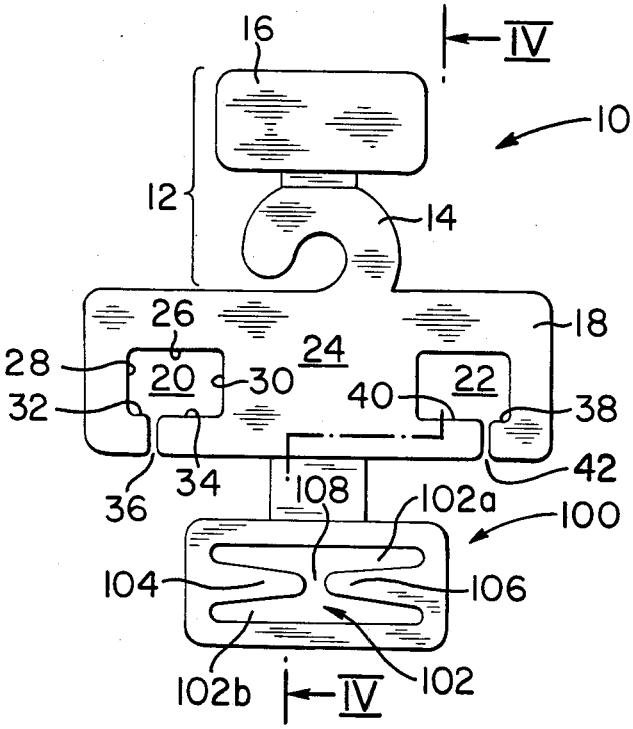
FIG. 1 is a front elevational view of a first embodiment of the hanger of the invention.
Figure 2:
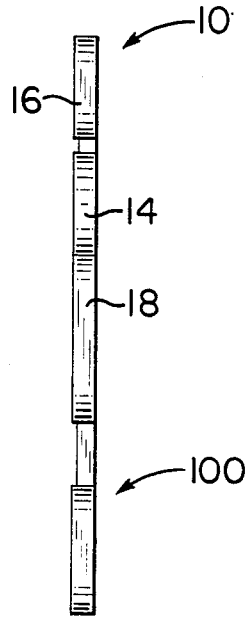
FIG. 2 is a side elevational view of the FIG. 1 hanger.
Figure 3:
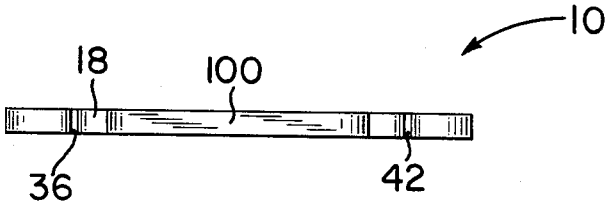
FIG. 3 is a bottom plan view of the FIG. 1 hanger.

Referring to FIGS. 1 through 4, hanger 10 is an integral body comprised of resilient synthetic material having a first or upper portion 12 inclusive of a hook 14 and a logo display area 16. A second or lower hanger portion 18 depends from upper portion 12 and is of generally rectangular configuration with its longer dimension horizontal. Openings 20 and 22 are provided through portion 18 aside a central expanse thereof. Considering opening 20, it is bounded in first part by continuous wall structure of the hanger body, including top wall 26, sidewalls 28 and 30 and bottom wall segments 32 and 34, and in second part by a hanger body discontinuity, providing passage 36 into opening 20 and separating bottom wall segments 32 and 34. Like boundary definition exists for opening 22, with bottom wall segments 38 and 40 having passage 42 therebetween providing access to opening 22.

Depending downwardly from portion 18 of hanger 10 is a further integral portion 100, which defines a necktie hanging opening 102 in the body and bounded throughout by further continuous wall structure of the body. The hanger body supports first and second deflectable members 104 and 106, which extend from opposite sides of opening 102 collectively across the major extent of the opening and defining thereby first and second portions 102*a* and 102*b* of such opening which are enterable upon deflection of one or both of members 104 and 106. Thus, members 104 and 106 have clearance 108 between facing ends thereof and desirably are of equal lengths, the sum of which is less than the larger side of the rectangularly configured opening 102.

Figure 10:
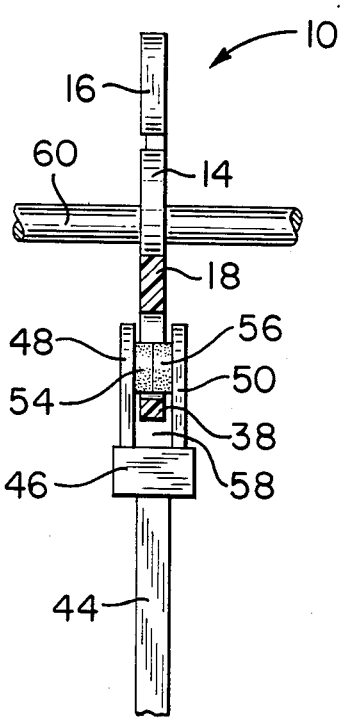
FIG. 10 is a partly-sectioned side elevation of the FIG. 9 assembly as would be seen from plane X—X of FIG. 9, with the necktie removed.

Turning to FIG. 10, suspender strap 44, of known elastic structure in synthetic or natural cloth material, has a fitting 46 fixedly secured thereto and supporting jaws 48 and 50, typically of metal, for independent pivotal movement from open state for receipt of a trouser waistband to closed state for retentive engagement with the waistband. Gripping pads 54 and 56, typically of resilient synthetic material and of disc shape, are supported respectively on jaws 48 and 50 to frictionally engage the waistband.

In the known suspenders of the FIG. 10 type, jaws 48 and 50 may be mutually, releasably latched in such closed state or a snap clasping further jaw (not shown) may be included and pivotally supported by fitting 46 outboard of either jaw to latch with the opposite jaw. Such snap suspenders are generally of the type to which hanger 10 is addressed, and hanging thereof is effected without need for opening jaws 48 and 50, i.e., with the snap in closed state. Of consequence in this respect are the dimensions of pads 54 and 56, and the dimensions of interior passage 58 existing between pads 54, 56 and fitting 46, as discussed below.

Figure 8:
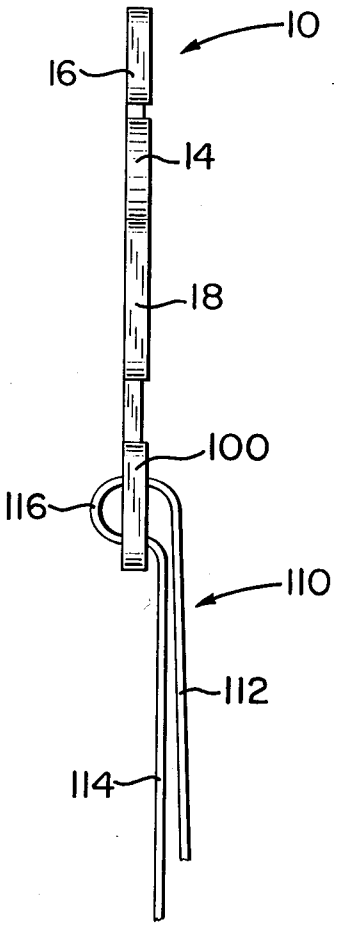
FIG. 8 is a left side elevation of the FIG. 7 assembly.
Figure 7:
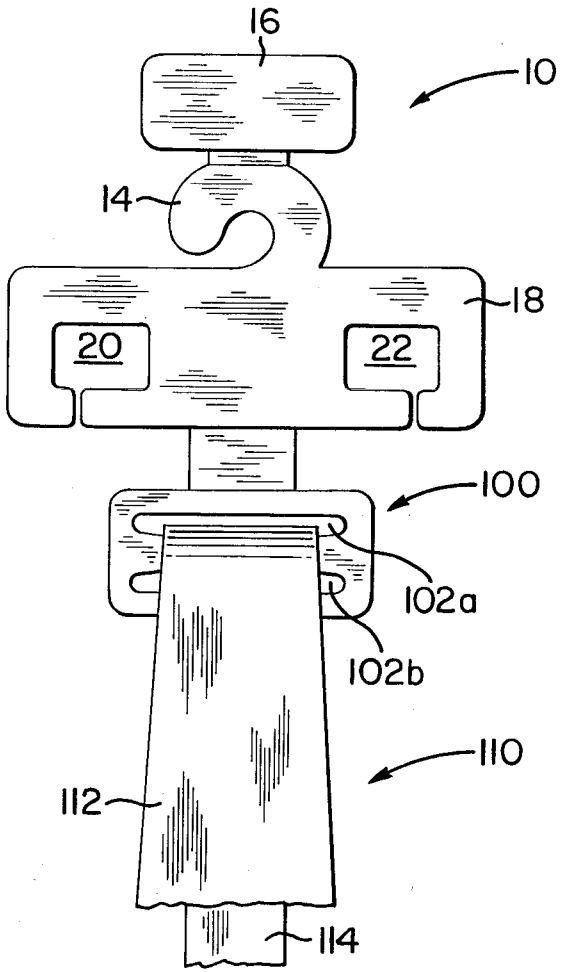
FIG. 7 is a front elevation of the assembly of a necktie with the FIG. 1 hanger.

A known type of necktie, shown in FIGS. 7 and 8, is a fabric 110 having a tapered portion 112 forming the tie proper upon knotting and underlying straight portion 114.

Figure 6:
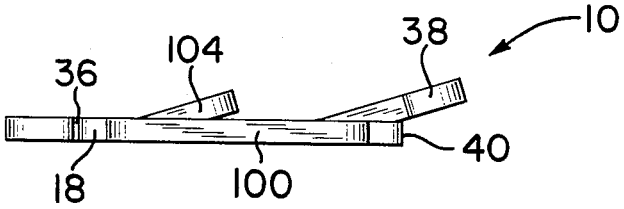
FIG. 6 is a bottom plan view of the FIG. 1 hanger in disposition for the receipt of a necktie and suspender snap.
Figure 4:
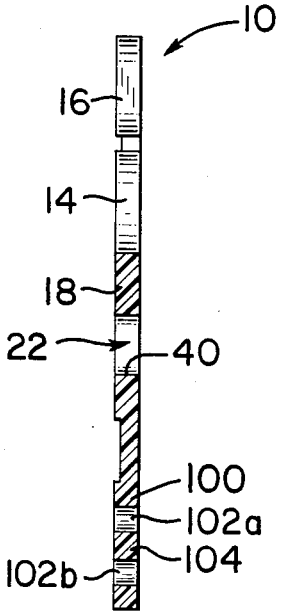
FIG. 4 is a sectional view of the FIG. 1 hanger as would be seen from plane IV—IV of FIG. 1.
Figure 5:
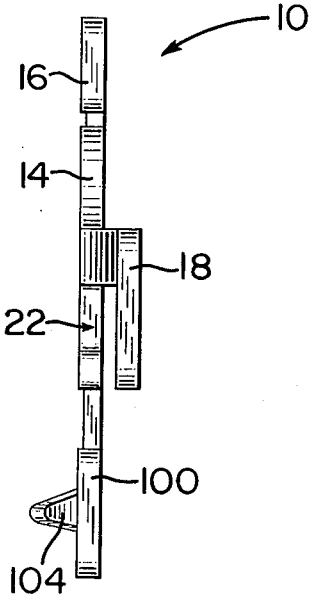
FIG. 5 is a side elevational view of the FIG. 1 hanger in disposition for the receipt of a necktie and a suspender snap.
Figure 9:
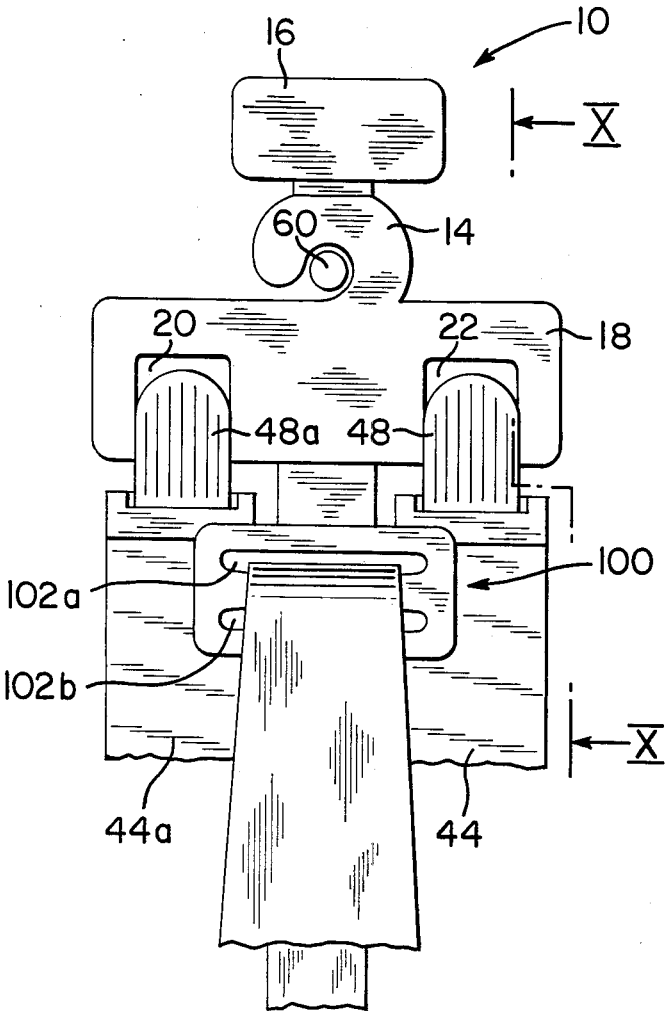
FIG. 9 is a front elevation of the assembly of the FIG. 1 hanger with both a necktie and suspenders.

FIGS. 5 and 6 depict hanger 10 with deflecting force applied to its rightward outboard extent, whereby such rightward outboard extent is displaced. This exposes the end of bottom wall segment 40 and opening 22 sidewardly of hanger 10, permitting movement of wall segment 40 into residence in suspender passage 58 (FIG. 10), and movement of pads 54 and 56 into residence in opening 22, without requiring the movement of jaws 48 and 50 to open state. The deflected portion of hanger 10 is now reversely deflected and bottom wall segment 38 also becomes resident in passage 58, in normal alignment with bottom wall segment 40, as is shown in FIG. 10, wherein hanger 10 is disposed hanging the suspenders from display rod 60. A second suspender strap 44*a* is shown in FIG. 9, with its associated fitting and jaw 48*a*, having its pads disposed in opening 20.

FIGS. 5 and 6 also depicts hanger 10 with deflecting force applied to member 104, whereby member 104 is displaced outwardly of the plane of hanger 10. This exposes the end of member 104 and passage 108 sidewardly of hanger 10, permitting movement of member 104 into residence in a loop 116 (FIG. 8) formed in tie 110, thus capturing successive courses of tie portions 112 and 114 in respective opening portions 102*a* and 102*b*. Deflected member 104 of hanger 10 is now reversely deflected and member 106 also becomes resident within the necktie loop 116, in normal alignment with member 104, as is shown in FIG. 8.

Figure 11:
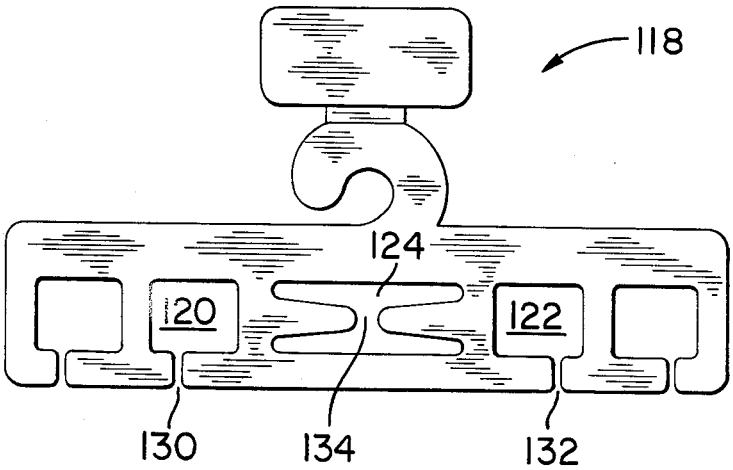
FIG. 11 is a front elevational view of a second embodiment of hanger in accordance with the invention.

FIG. 11 depicts a further embodiment of a hanger 118 in accordance with the invention, including suspender hanging openings 120 and 122 disposed oppositely aside necktie hanging opening 124, all such openings being in alignment and having respective entry passages 130, 132 and 134. As shown, an additional pair of suspender hanging openings may be provided outwardly of openings 120 and 122.

As will be appreciated, the asymmetrical lengths of the bottom wall segments bounding the suspender hanging openings, one segment being preferably more than twice the length of the other thereo, enhances retention of the suspender snap friction pads, since the passage into such openings are off-center with respect to the pad center when the assembly is effected.

Further, it will be appreciated that dimensions of the bottom wall segments of the suspender hanging openings are such as to permit residence thereof in passages 58, the suspender openings themselves being of dimension at least as large as the dimensions of the friction pads.

Various changes in structure and modifications in practice may be introduced without departing from the invention. The particularly depicted preferred embodiments and described practices are accordingly intended in a descriptive and not in a limiting sense. The true spirit and scope of the invention is set forth in the following claims.

What we claim is:

1. In combination:

(a) a necktie;

(b) suspenders of the type having snap means with a first open state for receiving a trousers waistband and a second closed state for closure retentively upon said waistband; and (c) a hanger comprising an integral body having a first portion for engaging a display rod, and a second portion depending from said first portion and defining at least one pair of suspender hanging openings therethrough, said snap means being resident in said suspender hanging openings and said suspenders depending from said hanger second portion, each said suspender hanging opening being bounded in first part by continuous wall structure of said body and in second part by a discontinuity in said body providing a passage into said suspenders hanging openings, first and second segments of said wall structure respectively aside said passage being mutually deflectable, permitting the receipt in said suspender hanging openings of said snap means in such closed state thereof, said hanger further defining a necktie hanging opening in said body and bounded throughout by further continuous wall structure of said body, said hanger body supporting first and second deflectable members extending collectively across a major extent of said necktie hanging opening and defining thereby first and second opening portions, successive courses of said necktie being resident respectively in said first and second opening portions.

2. The invention claimed in claim 1 wherein said hanger includes a third portion depending from said second portion thereof, said necktie hanging opening being disposed in said third hanger portion.

3. The invention claimed in claim 1 wherein said necktie hanging opening is disposed in alignment with said suspender hanging openings.

4. The invention claimed in claim 1 wherein each said snap means includes a pair of jaws supported for movement into closed state, said jaws having respective friction members brought into mutual engagement upon such closure of said jaws, said suspender hanging openings being of dimensions exceeding the dimension of said friction members.

5. The invention claimed in claim 4 wherein said jaws define a passage therethrough interiorly adjacent said friction members, said first and second wall structure segments having dimensions less than the dimension of such jaw passage.

6. The invention claimed in claim 1 wherein said suspender hanging openings are generally rectangular, said first and second wall structure segments jointly constituting one side of such rectangle.

7. The invention claimed in claim 6 wherein said first and second wall structure segments are of respective different lengths.

8. The invention claimed in claim 7 wherein said first wall structure segment is of length more than twice the length of said second wall segment.

9. The invention claimed in claim 1 wherein said second hanger portion is of rectangular configuration with its longer dimension horizontal, said suspender hanging openings being two in number and each of rectangular configuration, said second hanger portion defining a solid central expanse between said suspender hanging openings, said first and second wall structure segments for each such suspender hanging opening extending horizontally therebelow.

10. The invention claimed in claim 9 wherein such second wall structure segment for each said opening is horizontally outward of such first wall structure segment thereof, said first wall structure segment being of length at least twice the length of said second wall structure segment.

* * * * *